US008814753B2

(12) United States Patent
Lam

(10) Patent No.: US 8,814,753 B2
(45) Date of Patent: Aug. 26, 2014

(54) TOY WITH LIGHT EMITTING FUNCTION ACCOMPLISHED BY ROTARY MOTION OF A ROPE AROUND A HANDLE

(71) Applicant: Ying Lam, New Territories (HK)

(72) Inventor: Ying Lam, New Territories (HK)

( * ) Notice: Subject to any disclaimer, the term of this patent is extended or adjusted under 35 U.S.C. 154(b) by 0 days.

(21) Appl. No.: 13/894,442

(22) Filed: May 15, 2013

(65) Prior Publication Data

US 2013/0324367 A1 Dec. 5, 2013

(30) Foreign Application Priority Data

May 29, 2012 (CN) ..... 2012 2 0248021 U

(51) Int. Cl.
*A63B 24/00* (2006.01)
*A63B 5/20* (2006.01)

(52) U.S. Cl.
USPC ..... 482/2; 482/1; 482/8; 482/81; 482/82

(58) Field of Classification Search
USPC ..... 482/1–9, 81, 82, 900–902; 434/247; 362/169; 446/236
See application file for complete search history.

(56) References Cited

U.S. PATENT DOCUMENTS

| | | | | |
|---|---|---|---|---|
| 4,776,585 | A * | 10/1988 | Maleyko et al. | 482/82 |
| 7,156,779 | B2 * | 1/2007 | Rudell et al. | 482/81 |
| 7,892,145 | B2 * | 2/2011 | Lovett et al. | 482/3 |
| 2007/0129220 | A1 * | 6/2007 | Bardha | 482/82 |

* cited by examiner

*Primary Examiner* — Glenn Richman

(57) ABSTRACT

A toy with light emitting function comprises a rope and handles; the rope is transparent and has light emitting diodes (LEDs) inside; a first handle of the handles has a micro generator device connected with the LEDs; the micro generator device comprises a gear assembly and a micro generator motor; an end of the rope is fixedly connected with a first end of a connection member; a second end of the connection member is connected with a dynamic power input end of the gear assembly; the connection member drives the gear assembly to rotate with respect to the first handle along with rotary motion of the rope; a dynamic power output end of the gear assembly is connected with a driving axis of the micro generator motor; an electricity power output end of the micro generator motor is connected with the LEDs.

10 Claims, 5 Drawing Sheets

TOY WITH LIGHT EMITTING FUNCTION ACCOMPLISHED BY ROTARY MOTION OF A ROPE AROUND A HANDLE

BACKGROUND OF THE INVENTION

The present invention relates to a kind of toy, and more specifically relates to a toy with light emitting function accomplished by rotary motion of a rope body around a handle.

Jump rope is a very popular kind of sports equipment. Jump rope has simple structure and low production cost and it is convenient to use. Jump ropes currently available in the market have more or less the same structure according to which two handles are connected to two ends of a rope respectively to form a jump rope. In general, the rope is made of plastic, rubber or fiber etc, and it is solid in structure. A common jump rope currently available in the market can only support jumping activity but fail to support other functions, such as light emitting of the rope. To overcome the said deficiency, a light emitting jump rope is now available in the market, for example a multi-functional jump rope disclosed by China utility model patent application number 201120070490.4. According to the China utility model patent application, light emitting effect of the jump rope is accomplished by a string of multi-color light emitting diodes (LEDs) in the rope; the LEDs are lightened by electricity generated from a kind of special micro and elongated generators inside the jump rope handles when the generators are driven by rotary motion of the jump rope around the jump rope handles during user's exercise. As said, inside the jump rope handles of this kind of jump rope there exists a kind of special micro and elongated generator devices particularly designed to adapt to the special shapes of tool grips and handles. Since the jump rope has two handles, each handle will be installed with one of the special generator devices as mentioned above. This kind of jump rope generates electricity via the special generator devices by making use of the energy produced by the body during exercise to lighten the string of LEDs inside the rope and produce light emitting effect. However, this kind of light emitting jump rope has the following disadvantages: Use of the specifically designed special micro and elongated generator devices and use of which inside two jump rope handles at the same time make the structure of the jump rope complicated; in particular, since the generator devices are of a special type, they are difficult to process during manufacture and they are also expensive to manufacture; besides, they are also uncommon and difficult to repair, thereby not suitable for extensive promotion and use in the market.

BRIEF SUMMARY OF THE INVENTION

In view of the aforesaid disadvantages now present in the prior art, the present invention provides a toy with light emitting function accomplished by rotary motion of a rope body around a handle. The present invention is simple and reasonable in terms of its structure and durable to use; also, its processing cost is low and it is easy to manufacture and convenient to use. The present invention may be used as a jump rope and may also be used as other toys which involve rotary motion of a rope around a handle, for example a toy meteor hammer.

The present invention is attained as follows:

A toy with light emitting function accomplished by rotary motion of a rope body around a handle comprises a rope and handles connected with the rope, and the rope is transparent and disposed with light emitting diodes (LEDs) inside; the toy is characterized in that, in a first handle of the handles, there is a micro generator device connected with the LEDs inside the rope; the micro generator device comprises a gear assembly and a micro generator motor; an end of the rope is fixedly connected with a first end of a connection member; a second end of the connection member is connected with a dynamic power input end of the gear assembly; the connection member drives the gear assembly to rotate with respect to the first handle along with rotary motion of the rope; a dynamic power output end of the gear assembly is connected with a driving axis of the micro generator motor; an electricity power output end of the micro generator motor is connected with the LEDs inside the rope.

The connection member comprises an "L" shaped hard hollow tube; a main purpose for using the "L" shaped hard hollow tube is to ensure that the end of the rope rotates precisely using the first handle as a center of rotation, so that dynamic power as great as possible is input to drive the gear assembly and thus drive the micro generator motor; the hard hollow tube offers greater protection of the soft rope and prevents twisting and tangling of the rope; of course, the hard hollow tube can still achieve similar effect if it adopts a shape that is similar to an "L" shape.

The hard hollow tube can be made of acrylonitrile butadiene styrene (ABS) plastic to attain greater hardness.

The connection member also comprises a hard fixing block; an end of the hard fixing block is fixedly connected with the hard hollow tube, and another end of the hard fixing block is connected with the dynamic power input end of the gear assembly.

The gear assembly is a step-up gear assembly; the dynamic power output end of the gear assembly is connected with the driving axis of the micro generator motor; the step-up gear assembly is a 4-stage step-up gear assembly.

The micro generator motor can be a micro motor of model number HL151-10300-38MM with rated output voltage being 4.5V.

The electricity power output end of the micro generator motor is connected with two copper contact pieces via two wires respectively; the two copper contact pieces are fixedly provided inside the first handle; the two copper contact pieces are not connected with each other; outer surface of the connection member is symmetrically provided with two arc-shaped copper plates; the two arc-shaped copper plates are not connected with each other; one end of each of the two arc-shaped copper plates extends into the connection member; the connection wires for connecting cathodes and anodes of the LEDs inside the rope extend out from the end of the rope and fixedly connect respectively with portions of the arc-shaped copper plates extended into the connection member; the two copper contact pieces contact the connection member at opposite positions which are 180 degree apart with respect to each other on the connection member; when the connection member rotates, the two copper contact pieces intermittently contact with the two arc-shaped copper pieces respectively, so that the LEDs inside the rope are electrically connected with the micro generator motor intermittently.

Each of the handles is an assembly of two parts which are assembled together and fixedly connected using screws. Interior part of the first handle is provided with cavities which correspond to positions of the "L" shaped hard hollow tube, the gear assembly and the micro generator motor; shapes of the cavities also correspond to shapes of components to be fitted in so that the components can be securely fixed inside the first handle.

The rope is a soft, transparent and hollow tube; inside the rope, there is a string of light bulbs constituted by a plurality of the LEDs interconnected via the connection wires.

The toy is a jump rope or a toy meteor hammer.

The present invention operates as follows: when a user starts swinging the rope, the rope moves around the first handle in rotary motion; as the rope rotates, the connection member and the gear assembly are driven to rotate with respect to the first handle; since the gear assembly is a step-up gear assembly, it can transform the relatively slower rotation of the rope into faster rotation as output rotation so that the micro generator motor is driven to rotate in a faster speed; when the micro generator motor rotates, it generates electricity; the electricity is then output to the LEDs inside the rope via the wires, the copper contact pieces, the arc-shaped copper pieces and the connection wires of the LEDs, and then lightens the LEDs; since the rope is made of transparent material, lights of the LEDs can be emitted through the rope, thereby achieving light emitting effect; besides, since the two copper contact pieces only intermittently contact with the two arc-shaped copper pieces respectively when the rope rotates, intermittent light flashing effect can also be achieved; by changing the length of the arc-shaped copper pieces, light flashing pattern may also be changed.

Compared with the existing prior art, the present invention has the following advantages and beneficial effects:

(1) The present invention does not need a special generator device since the generator device of the present invention generates electricity using the micro generator motor which is driven by the gear assembly; also, the generator device of the present invention is only required to be installed in one handle at one end of the rope, and it is not required to be installed in both of the handles even when the present invention is a jump rope. Therefore, compared with the existing prior art, the present invention has a simpler and a more reasonable structure and uses easily obtainable components, thereby achieving easier production, lower processing cost, better applicability and easier maintenance.

(2) The present invention can sufficiently convert the dynamic power produced by swinging the rope into electricity for use. As such, batteries and other kinds of electrical power sources are not necessary, thereby achieving energy conservation and environmental friendliness.

(3) When using the present invention, the rope can emit lights. On one hand, the lights are decorative and therefore enable a more joyful playing experience. On the other hand, the lights may help users determine the rope's position and therefore help users count the number of jumps and help users understand the whole rope jumping process etc, thereby achieving greater convenience when using the present invention.

(4) The present invention can achieve intermittent light flashing effect without using complicated electrical circuits, thereby achieving low production cost and bringing greater pleasure to users.

DETAILED DESCRIPTION OF THE INVENTION

The present invention is further described in detail below with reference to embodiments and the accompanying drawings. However, the present invention should not be limited to the detailed description given below.

Figure 1:
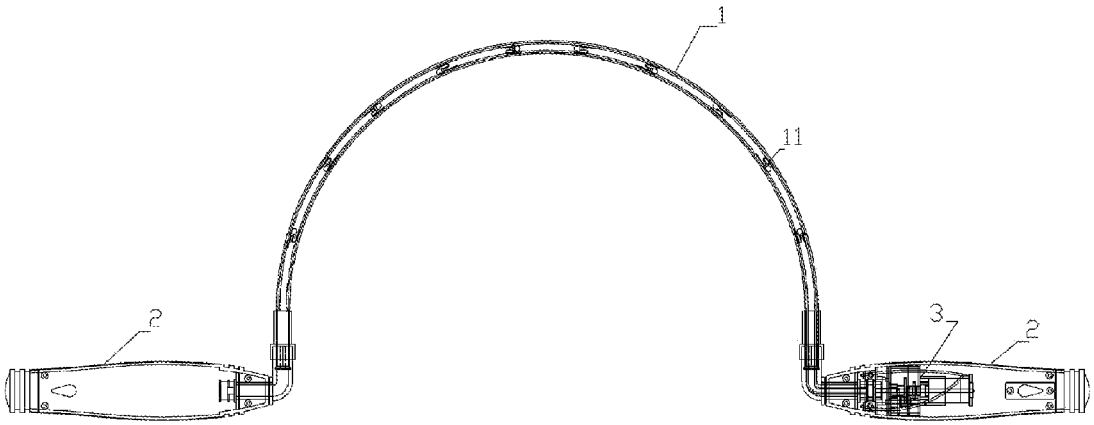
FIG. 1 shows the overall structure of the present invention according to the first embodiment.
Figure 2:
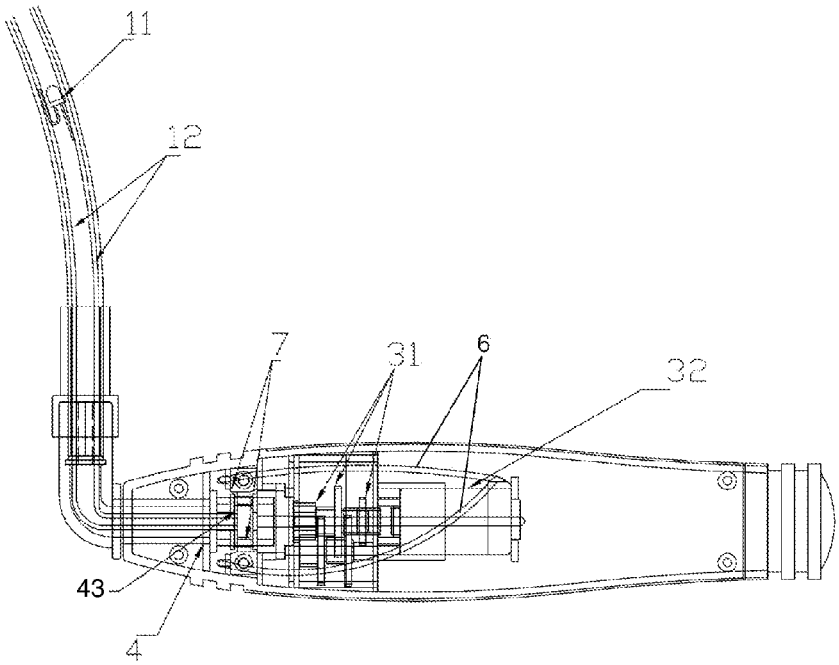
FIG. 2 shows the detailed structure of a first handle at one end of the rope as shown in FIG. 1.

FIG. 1 to FIG. 5 illustrate a detailed structure of the present invention according to the first embodiment. As shown in FIG. 1, the present invention is a jump rope comprising a rope 1 and handles 2 connected with the rope. The rope 1 is a soft, transparent and hollow tube. Inside the rope, there is a string of light bulbs constituted by a plurality of LEDs 11 interconnected via connection wires 12. In a first handle of the handles 2, there is a micro generator device 3 connected with the LEDs 11 inside the rope 1. The micro generator device 3 comprises a gear assembly 31 and a micro generator motor 32. An end of the rope 1 is fixedly connected with a first end of a connection member 4. A second end of the connection member 4 is connected with a dynamic power input end of the gear assembly 31. The connection member 4 drives the gear assembly 31 to rotate with respect to the first handle along with rotary motion of the rope 1. A dynamic power output end of the gear assembly 31 is connected with a driving axis 321 of the micro generator motor 32. An electricity power output end of the micro generator motor 32 is connected with the LEDs 11 inside the rope 1.

The connection member 4 comprises an "L" shaped hard hollow tube 41 and a hard fixing block 42. An end of the hard fixing block 42 is fixedly connected with the hard hollow tube 41 and another end of the hard fixing block 42 is connected with the dynamic power input end of the gear assembly 31. The main purpose of using the "L" shaped hard hollow tube 41 is to ensure that the end of the rope 1 rotates precisely using the first handle as a center of rotation, so that dynamic power as great as possible can be input to drive the gear assembly 31 and thus drive the micro generator motor 32. The hard hollow tube 41 may be made of acrylonitrile butadiene styrene (ABS) plastic to attain greater hardness to offer greater protection of the soft rope 1 and prevent twisting and tangling of the rope. Of course, the hard hollow tube 41 can still achieve similar effect if it adopts a shape that is similar to an "L" shape.

Figure 3:
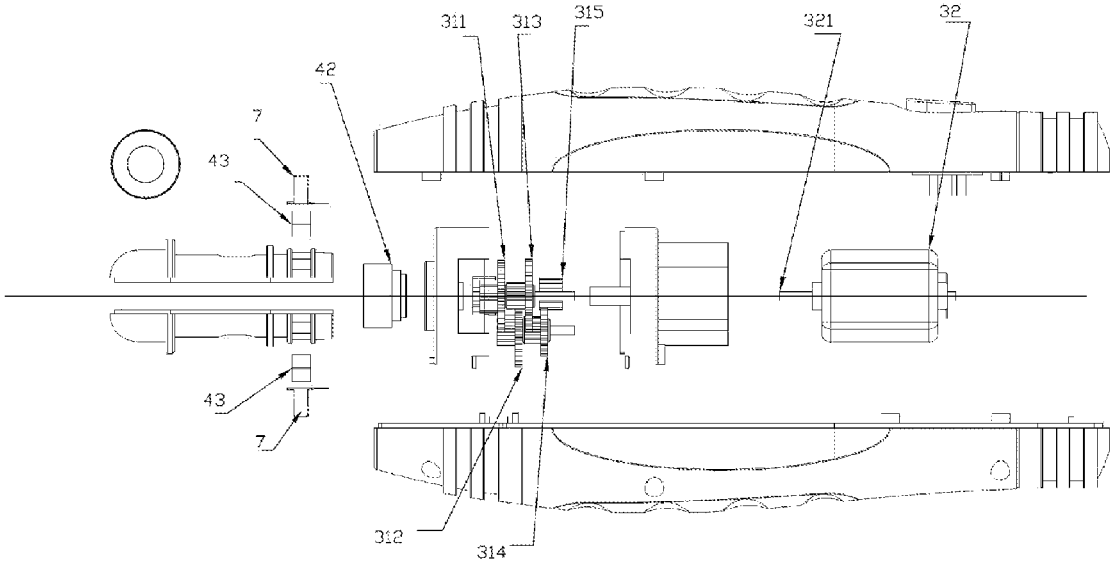
FIG. 3 is an exploded view of the first handle as shown in FIG. 2.
Figure 4:
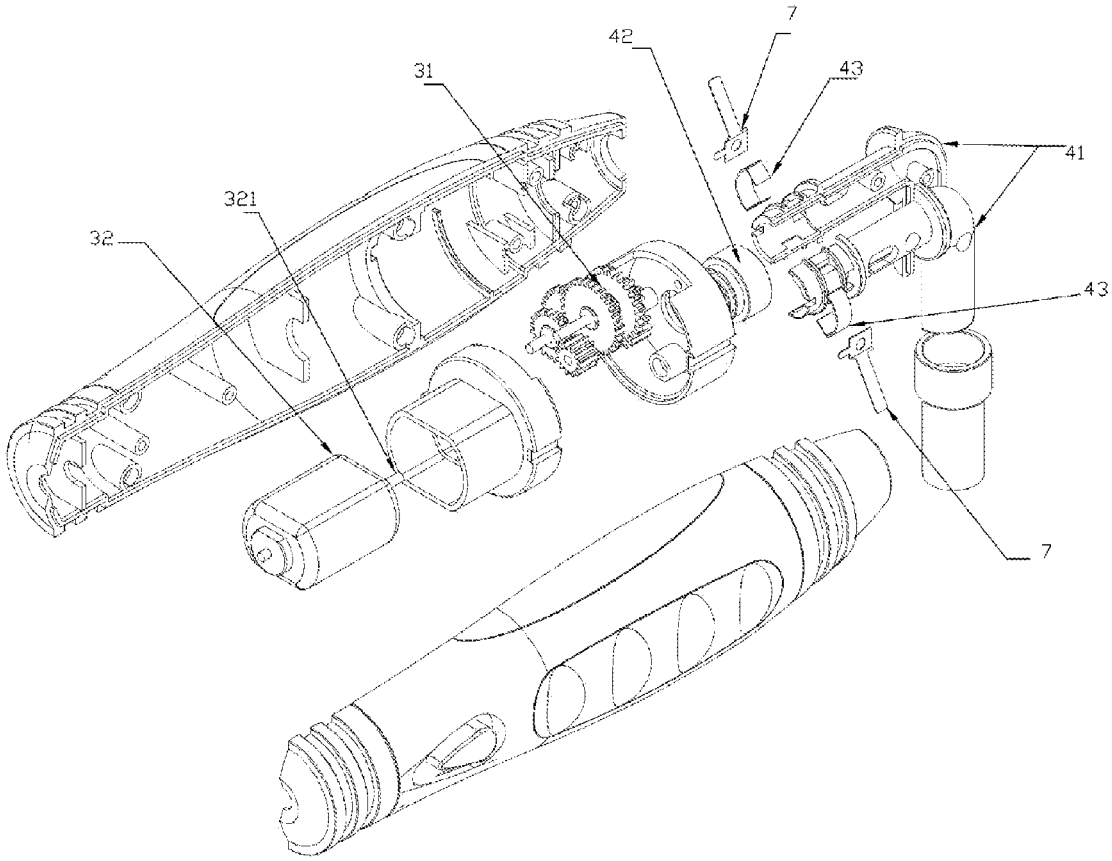
FIG. 4 is a perspective view of the exploded view of the first handle as shown in FIG. 3.
Figure 5:
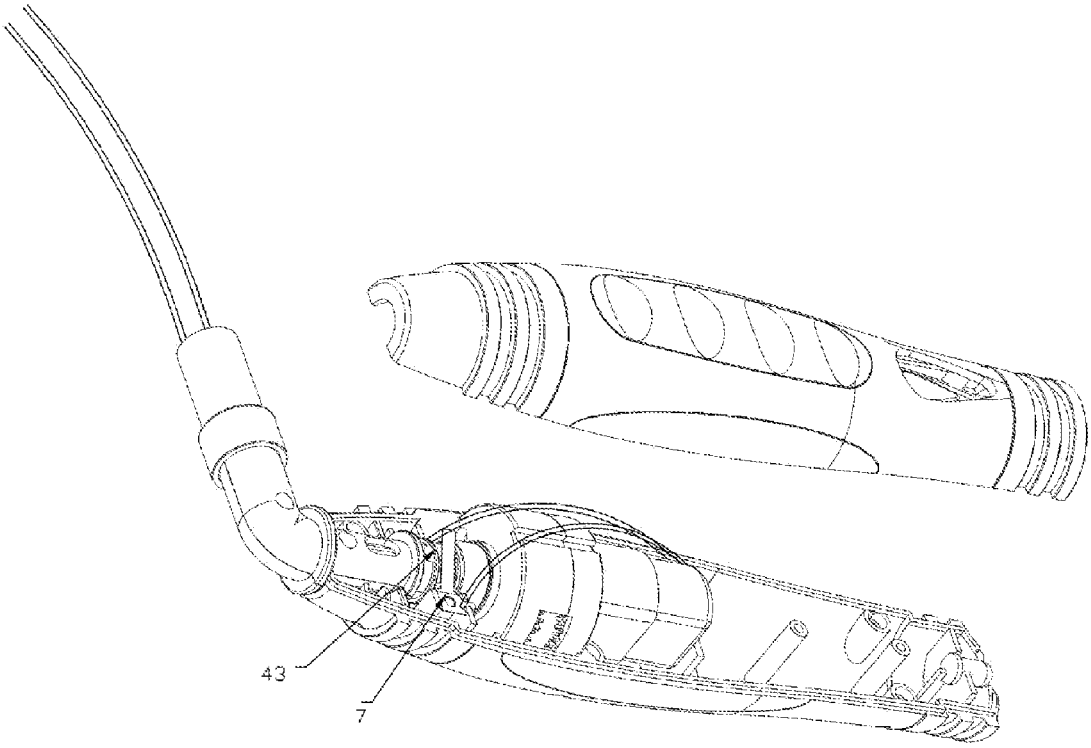
FIG. 5 shows the connection between an arc-shaped copper piece on a connection member and a copper contact piece inside the first handle.

The gear assembly 31 is a step-up gear assembly. As shown in FIG. 3 and FIG. 4, the dynamic power output end of the gear assembly is connected with the driving axis 321 of the micro generator motor 32. The step-up gear assembly according the present embodiment is a 4-stage step-up gear assembly comprising four gears 311, 312, 313, 314 and a fifth gear 315 which sleeves the driving axis 321 of the micro generator motor 32. The four gears 311, 312, 313, 314 are sequentially engaged and rotate, and the fifth gear 315 which sleeves the driving axis 321 of the micro generator motor 32 is engaged with the fourth gear 314.

The electricity power output end of the micro generator motor 32 is connected with two copper contact pieces 7 via two wires 6 respectively. The two copper contact pieces 7 are fixedly provided inside the first handle. The two copper contact pieces 7 are not connected with each other. Outer surface of the "L" shaped hard hollow tube 41 is symmetrically provided with two arc-shaped copper plates 43. The two arc-shaped copper plates 43 are not connected with each other. One end of each of the two arc-shaped copper plates 43 extends into the "L" shaped hard hollow tube 41. The connection wires 12 for connecting cathodes and anodes of the LEDs 11 inside the rope 1 extend out from the end of the rope 1 and fixedly connect respectively with portions of the arc-shaped copper plates 43 extended into the "L" shaped hard hollow tube 41. The two copper contact pieces 7 contact the "L" shaped hard hollow tube 41 at opposite positions which are 180 degree apart with respect to each other on the hard hollow tube. When the "L" shaped hard hollow tube 41 rotates, the two copper contact pieces 7 intermittently contact with the two arc-shaped copper pieces 43 respectively, so that the LEDs 11 inside the rope 1 are electrically connected with the micro generator motor 32 intermittently. In the present embodiment, the micro generator motor 32 can be a micro motor of model number HL151-10300-38MM with rated output voltage being 4.5V.

Each of the handles 2 is an assembly of two parts which are assembled together and fixedly connected using screws. Interior part of the first handle is provided with cavities which correspond to positions of the "L" shaped hard hollow tube 41, the gear assembly 31 and the micro generator motor 32. Shapes of the cavities also correspond to shapes of components to be fitted in so that the components can be securely fixed inside the first handle.

The present invention operates as follows: During rope jumping, the rope 1 moves around the first handle in rotary motion. As the rope 1 rotates, the connection member 4 and the gear assembly 31 are driven to rotate with respect to the first handle. Since the gear assembly 31 is a step-up gear assembly, it can transform the relatively slower rotation of the rope 1 into faster rotation as output rotation so that the driving axis 321 of the micro generator motor 32 is driven to rotate in a faster speed. When the micro generator motor 32 rotates, it generates electricity. The electricity is then output to the LEDs 11 inside the rope 1 via the wires 6, the copper contact pieces 7, the arc-shaped copper pieces 43 and the connection wires 12 of the LEDs 11, and then lightens the LEDs. Since the rope 1 is made of transparent material, lights of the LEDs 11 can be emitted through the rope 1. Light emitting effect during rope jumping is therefore achieved. Besides, since the two copper contact pieces 7 will only intermittently contact with the two arc-shaped copper pieces 43 respectively when the rope 1 rotates, intermittently light flashing effect can also be achieved. By changing the length of the arc-shaped copper pieces 43, light flashing pattern may also be changed.

Figure 6:
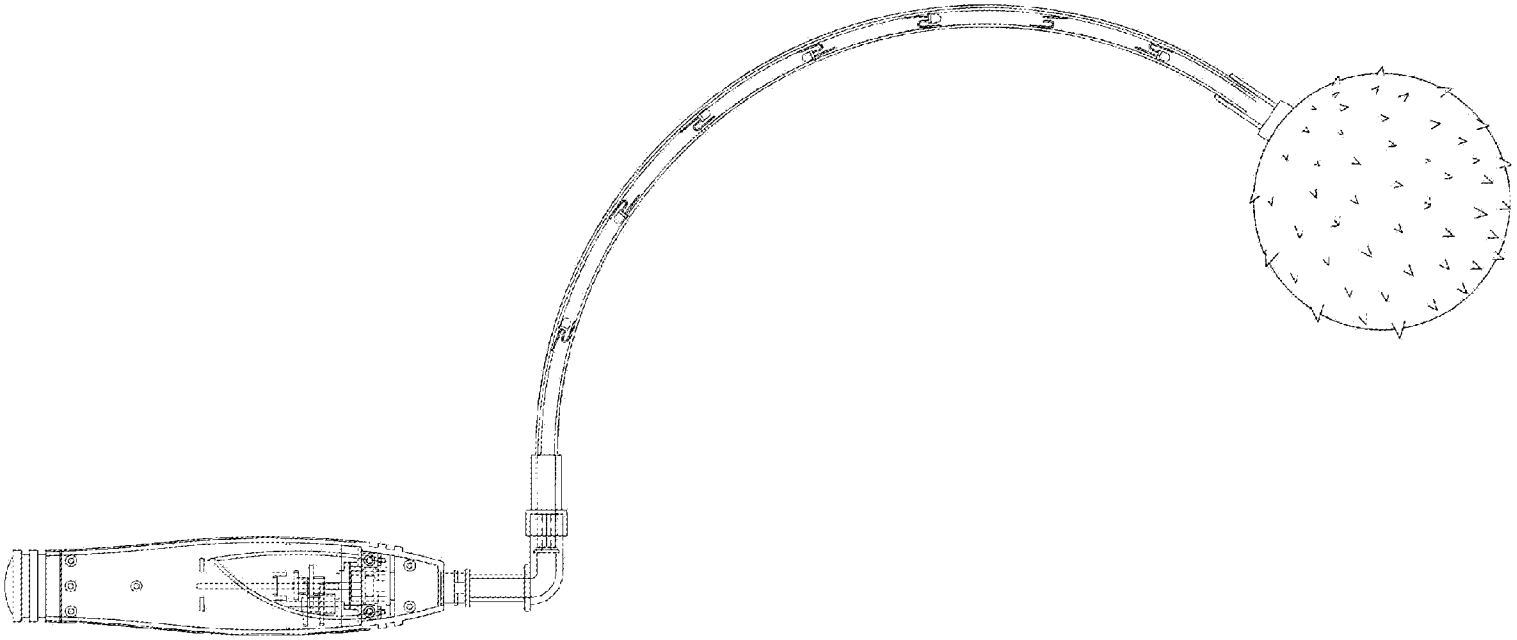
FIG. 6 shows the overall structure of the present invention according to the second embodiment.

FIG. 6 illustrates a second embodiment of the present invention. The second embodiment is essentially the same as the first embodiment, except that the present invention according to the second embodiment is a toy meteor hammer.

The above embodiments are only the preferred description of the present invention. The present invention should not be limited to the above embodiments. Any other change, modification, replacement, combination or simplification which does not deviate from the spirit and principle of the present invention should be considered an equally acceptable alternative and should fall within the scope of protection of the present invention.

What is claimed is:

1. A toy with light emitting function accomplished by rotary motion of a rope body around a handle comprises a rope and handles connected with the rope, and the rope is transparent and disposed with light emitting diodes (LEDs) inside; wherein in a first handle of the handles, there is a micro generator device connected with the LEDs inside the rope; the micro generator device comprises a gear assembly and a micro generator motor; an end of the rope is fixedly connected with a first end of a connection member; a second end of the connection member is connected with a dynamic power input end of the gear assembly; the connection member drives the gear assembly to rotate with respect to the first handle along with rotary motion of the rope; a dynamic power output end of the gear assembly is connected with a driving axis of the micro generator motor; an electricity power output end of the micro generator motor is connected with the LEDs inside the rope.

2. The toy as in claim 1, wherein the connection member comprises an "L" shaped hard hollow tube.

3. The toy as in claim 2, wherein the connection member also comprises a hard fixing block; an end of the hard fixing block is fixedly connected with the hard hollow tube, and another end of the hard fixing block is connected with the dynamic power input end of the gear assembly.

4. The toy as in claim 1, wherein the gear assembly is a step-up gear assembly; the dynamic power output end of the gear assembly is connected with the driving axis of the micro generator motor.

5. The toy as in claim 4, wherein the step-up gear assembly is a 4-stage step-up gear assembly.

6. The toy as in claim 1, wherein the micro generator motor has a rated output voltage of 4.5V.

7. The toy as in claim 1, wherein the electricity power output end of the micro generator motor is connected with two copper contact pieces via two wires respectively; the two copper contact pieces are fixedly provided inside the first handle; the two copper contact pieces are not connected with each other; outer surface of the connection member is symmetrically provided with two arc-shaped copper plates; the two arc-shaped copper plates are not connected with each other; one end of each of the two arc-shaped copper plates extends into the connection member; the connection wires for connecting cathodes and anodes of the LEDs inside the rope extend out from the end of the rope and fixedly connect respectively with portions of the arc-shaped copper plates extended into the connection member; the two copper contact pieces contact the connection member at opposite positions which are 180 degree apart with respect to each other on the connection member; when the connection member rotates, the two copper contact pieces intermittently contact with the two arc-shaped copper pieces respectively, so that the LEDs inside the rope are electrically connected with the micro generator motor intermittently.

8. The toy as in claim 2, wherein each of the handles is an assembly of two parts which are assembled together and fixedly connected using screws; interior part of the first handle is provided with cavities which correspond to positions of the "L" shaped hard hollow tube, the gear assembly and the micro generator motor; shapes of the cavities also correspond to shapes of components to be fitted in so that the components can be securely fixed inside the first handle.

9. The toy as in claim 1, wherein the rope is a soft, transparent and hollow tube; inside the rope, there is a string of light bulbs constituted by a plurality of the LEDs interconnected via the connection wires.

10. The toy as in claim 1, wherein the toy is a jump rope or a toy meteor hammer.

* * * * *